US007545321B2

(12) United States Patent
Kawasaki

(10) Patent No.: US 7,545,321 B2
(45) Date of Patent: Jun. 9, 2009

(54) ARRAY ANTENNA CALIBRATION APPARATUS AND METHOD

(75) Inventor: Toshio Kawasaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 617 days.

(21) Appl. No.: 11/209,626

(22) Filed: Aug. 24, 2005

(65) Prior Publication Data

US 2006/0273959 A1 Dec. 7, 2006

(30) Foreign Application Priority Data

May 19, 2005 (JP) ..... 2005-147249

(51) Int. Cl.
*H01Q 3/00* (2006.01)

(52) U.S. Cl. ..... 342/368; 342/174; 342/374

(58) Field of Classification Search ..... 342/368, 342/374, 174

See application file for complete search history.

(56) References Cited

U.S. PATENT DOCUMENTS

| | | | | |
|---|---|---|---|---|
| 5,657,023 | A * | 8/1997 | Lewis et al. | 342/174 |
| 6,624,784 | B1 * | 9/2003 | Yamaguchi | 342/372 |
| 6,747,595 | B2 | 6/2004 | Hirabe | 342/535 |
| 6,762,717 | B2 | 7/2004 | Hirabe | 342/368 |
| 2003/0058166 | A1 * | 3/2003 | Hirabe | 342/368 |
| 2004/0032365 | A1 * | 2/2004 | Gottl et al. | 342/368 |
| 2006/0072684 | A1 * | 4/2006 | Feher | 375/308 |

FOREIGN PATENT DOCUMENTS

| | | |
|---|---|---|
| EP | 0805514 | 1/1998 |
| EP | 1/294 047 | 3/2003 |
| EP | 1367670 | 12/2003 |
| JP | 2-265302 | 10/1990 |
| JP | 2003-92508 | 3/2003 |
| JP | 2003-21862 | 7/2003 |
| WO | WO 2004/023600 | 3/2004 |

* cited by examiner

*Primary Examiner*—Thomas H Tarcza
*Assistant Examiner*—Fred H Mull
(74) *Attorney, Agent, or Firm*—Myers Wolin, LLC

(57) ABSTRACT

The apparatus comprises a calibration signal supply means, which supplies calibration signals to a plurality of antenna elements that are to be subjected to calibration; a calibration signal extracting means, which extracts the calibration signals from signals received by the antenna elements placed, one on each side of the plurality of antenna elements that are to be subjected to calibration, and a calibration control means and which individually controls the phases of signals to be transmitted from the plurality of antenna elements that are to be subjected to calibration, based on the phase differences among the calibration signals extracted by the calibration signal extracting means. This will realize accurate calibration of an array antenna, irrespective of antenna element interval deviation.

19 Claims, 9 Drawing Sheets

ARRAY ANTENNA CALIBRATION APPARATUS AND METHOD

CROSS REFERENCE TO RELATED APPLICATIONS

This application is based on and hereby claims priority to Japanese Application No. 2005-147249 filed on May 19, 2005 in Japan, the contents of which are hereby incorporated by reference.

BACKGROUND OF THE INVENTION (1) Field of the Invention

The present invention relates to an array antenna calibration apparatus and an array antenna calibration method. The invention relates particularly to a technique for calibrating phase differences at array antenna ends.

(2) Description of the Related Art

Digital cellular radio communication systems employing the DS-CDMA (Direct Spread Code Division Multiple Access) technology have been developed as next-generation mobile communication systems. The CDMA scheme is an access scheme in which channels are assigned according to codes to make simultaneous communication available. In CDMA, signal interference of other channels used in simultaneous communication causes a problem of a limited number of channels available in simultaneous communication, thereby causing a limited channel capacity. To increase the channel capacity, techniques for restraining interference are effective.

An adaptive array antenna, which forms a beam for a desired user while it forms a null point for another user who becomes a significant source of interference, is an art for increasing the channel capacity. That is, the adaptive array antenna forms a beam in the direction of the desired user, and it directs a null point in the direction of the user who becomes a significant source of interference. This makes it possible to receive a radio wave from the desired user with high sensitivity, and not to receive a radio wave from the significant interference source, so that the amount of interference is reduced, thereby increasing the channel capacity.

Adaptive array antennas generate beams utilizing phase differences at antenna ends. Thus, phase variation in each radio unit will make it impossible to correctly control beam patterns.

Accordingly, correct control of beam patterns will necessitate correction of the phase difference at each antenna end. As a phase difference correction method, for example, calibration signals are multiplexed, and the phase difference of the multiplexed signals is detected and corrected.

For example, FIG. 9 is a block diagram showing an example of an array antenna calibration apparatus, and it is equivalent to FIG. 1 of the following patent document 1. The conventional apparatus of FIG. 9 includes: antenna elements 100-1 through 100-8 constituting a linear antenna; transmitters 103; a calibration signal generator 104; adders 105; circulators 106; a receiver 107; an RF switch 108; a calibration factor calculating unit 109; multipliers 110; a power combiner 111; a user signal multiplexing unit 112; beam formers 113 one for each user "1" through "n". User signals sent from the beam formers 113 are multiplexed by the user signal multiplexing unit 112. After that, each multiplier 110 multiplies the multiplexed signals by a calibration factor obtained by the calibration factor calculating unit 109, and then each adder 105 adds a calibration signal generated by the calibration signal generator 104. The resultant signals are input to the transmitters 103 and sent out from the corresponding antenna elements 100-1 through 100-6. The antenna elements 100-7 and 100-8, one on each side of the array antenna, are dummy antennas to each of which a non-reflection resistor 102 is coupled.

Here, the signals sent from the antenna elements 100-1 through 100-6 are electromagnetically coupled to the adjacent antenna elements and transmitted. These coupled components are taken out by the circulators 106 and are then received by the receiver 107 via the RF switch 108.

For example, calibration signals C1 and C3 sent from the antenna elements 100-1 and 100-3, respectively, are received by the antenna element 100-2 due to electromagnetic coupling between the antenna elements, and signals C1+C3 are taken out by the corresponding circulator 106 and are then input to one of the ports of the RF switch 108. In the similar manner, signals C2+C4, signals C3+C5, and signals C4+C6 are input, one to each of the other ports of the RF switch 108. Here, signals C3 and C5, electromagnetically coupled to the antenna elements 100-1 and 100-6, are power-synthesized by the power combiner 111 and are then received by the receiver 107 via the RF switch 108.

After that, the ports of the RF switch 108 are sequentially changed over, and the signal input to each port is demodulated and converted into a baseband signal by the receiver 107. The calibration factor calculating unit 109 measures the phase and the amplitude of each calibration signal to calculate a calibration factor. For example, signal patterns orthogonal to one another with no correlation therebetween are used as calibration signals C1 through C6, and signals C1 and C3 are subjected to correlation processing by the corresponding signal patterns of the signals C1 and C3, to obtain the phases and the amplitudes of the signals C1 and C3, and a factor for making uniform the amplitudes and the phases of the signals C1 and C3 is obtained. Likewise, the ports of the RF switch 108 are sequentially changed over, and factors for making uniform the amplitudes and the phases of signals C2 and C4, signals C3 and C5, signals C4 and C6, and signals C2 and C5 are individually obtained.

Next, from the thus obtained factors, calibration factors for making uniform the phases and the amplitudes of all the signals C1 through C6 are obtained, and the multipliers 110 multiply transmission signals by these calibration factors, thereby making it possible to make uniform the amplitudes and the phases of the signals sent from the antenna elements 100-1 through 100-6.

In addition, another conventional technique is disclosed in the following patent document 2. This conventional technique calibrates the phases and the amplitudes of antenna elements based on a component, coupled to each antenna element, of calibration signals sent from additive antennas disposed, one on each side of an array antenna and on a user signal received by each antenna element. This makes it possible to allow for the characteristics of a transmission path from the antenna elements to the receiver, and an array antenna calibration apparatus in which a positional relationship between a base station and a signal generator need not be acknowledged is realized.

[Patent Document 1] Japanese Patent Application Laid-Open No. 2003-218621

[Patent Document 2] Japanese Patent Application Laid-Open No. 2003-92508

However, in both of the above conventional arts, the phase differences among calibration signals are detected on the assumption that intervals between antenna elements are already known. Hence, a problem is that antenna element interval deviation will cause calibration-error.

SUMMARY OF THE INVENTION

With the foregoing problems in view, it is an object of the present invention to realize accurate calibration of antenna elements irrespective of antenna element interval deviation.

In order to accomplish the above object, the present invention provides an array antenna calibration apparatus and an array antenna calibration method.

(1) As a generic feature, there is provided an array antenna calibration apparatus for calibrating an array antenna having multiple antenna elements, the apparatus comprising: a calibration signal supply means which supplies calibration signals to a plurality of antenna elements that are to be subjected to calibration; a calibration signal detecting means which detects the calibration signals from signals received by the antenna elements placed, one on each side of the plurality of antenna elements that are to be subjected to calibration, and a calibration control means which individually controls the phases of signals to be transmitted from the plurality of antenna elements that are to be subjected to calibration, based on phase differences among the calibration signals detected by the calibration signal detecting means.

(2) As another generic feature, there is provided an array antenna calibration apparatus for calibrating an array antenna having multiple antenna elements, the apparatus comprising: a calibration signal supply means which supplies calibration signals to a plurality of antenna elements placed, one on each side of a plurality of antenna elements that are to be subjected to calibration; a calibration signal detecting means which detects the calibration signals from signals received by the plurality of antenna elements that are to be subjected to calibration; and a calibration control means which individually controls the phases of the signals received by the plurality of antenna elements that are to be subjected to calibration, based on phase differences among the calibration signals detected by the calibration signal detecting means.

(3) As a preferred feature, the antenna elements placed, one on each side of the plurality of antenna elements that are to be subjected to calibration are dummy antenna elements.

(4) As yet another generic feature, there is provided an array antenna calibration method for calibrating an array antenna having multiple antenna elements, the method comprising: emitting calibration signals from a plurality of antenna elements that are to be subjected to calibration; detecting the calibration signals from signals received by antenna elements that are placed, one on each side of the plurality of antenna elements that are to be subjected to calibration; and controlling individually the phases of signals to be sent from the plurality of antenna elements based on phase differences among the detected calibration signals.

(5) As a further generic feature, there is provided an array antenna calibration method for calibrating an array antenna having multiple antenna elements, the method comprising: emitting calibration signals from antenna elements placed, one on each side of a plurality of antenna elements that are to be subjected to calibration; detecting the calibration signals from signals received by the plurality of antenna elements; and controlling individually the phases of the signals received by the plurality of antenna elements based on phase differences among the detected calibration signals.

According to the present invention, for both a downlink and an uplink, antenna elements (e.g., dummy antennas) disposed, one on each side of antenna elements that are to be subjected to calibration, are used for transceiving calibration signals, thereby realizing accurate, antenna element interval-independent calibration. Accordingly, antenna element interval deviation is allowed, and array antenna yields are reduced, thereby contributing to reduction of the manufacturing cost.

Other objects and further features of the present invention will be apparent from the following detailed description when read in conjunction with the accompanying drawings.

DESCRIPTION OF THE PREFERRED EMBODIMENT(S)

[1] First Embodiment

Figure 1:
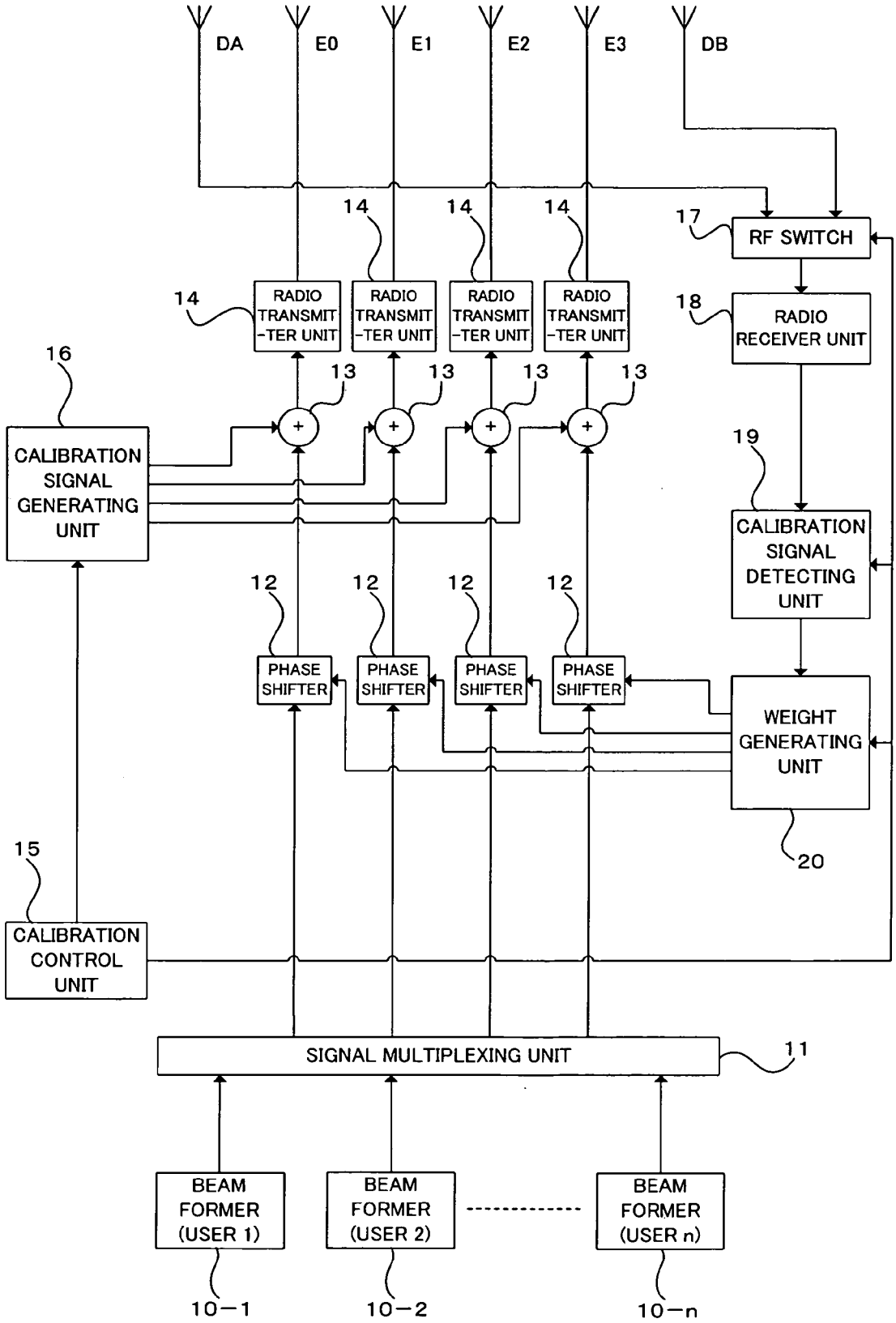
FIG. 1 is a block diagram showing a construction (downlink) of a radio transmitter to which an array antenna calibration apparatus of a first embodiment of the present invention is applied.

FIG. 1 is a block diagram showing a construction (for downlink) of a radio transmitter to which an array antenna calibration apparatus of a first embodiment of the present invention is applied. The radio transmitter of FIG. 1 includes: antenna elements E0, E1, E2, E3, DA, and DB (in FIG. 1, a total of six antenna elements) constituting a linear array antenna; beam formers 10-1 through 10-n (n is an integer not smaller than 2) for multiple users; a signal multiplexing unit 11; phase shifters 12, adders 13, and radio transmitter units 14 provided, one for each of the antenna elements E0, E1, E2, and E3; a calibration control unit 15; a calibration signal generating unit 16; an RF switch 17; a radio receiver unit 18; a calibration signal detecting unit 19; a weight generating unit 20. Antenna elements DA and DB disposed, one on each side of the linear array antenna, are dummy antennas for shaping emission patterns from the antenna elements E0, E1, E2, and E3. Note that the number of antenna elements should by no means be limited to the above.

Here, each beam former 10-*i* (i=1 through n) outputs a user signal which forms a beam having a directivity for each user. The signal multiplexing unit 11 multiplexes the user signals obtained from the beam formers 10-*i*. Each phase shifter 12 adjusts the phase of the multiplexed user signals, which are multiplexed by the signal multiplexing unit 11, according to a weighting factor obtained from the weight generating unit 20. Each adder 13 adds a calibration signal generated by the calibration signal generating unit 16 to the signal (main signal) which has undergone phase adjustment by the phase shifters 12. The radio transmitter units 14 carry out necessary radio transmission processing, such as modulating the calibration-signal-added signal by a specific modulation method and upconverting the modulated signal to a radio signal, and then sends the thus obtained radio signal from the antenna elements E0, E1, E2, and E3.

That is, the calibration signal generating unit 16, the adders 13, and radio transmitter units 14 serve as a calibration signal supply means for supplying calibration signals to antenna elements E0, E1, E2, and E3 that are to be subjected to calibration.

In addition, the calibration control unit 15 controls calibration of the antenna elements E0, E1, E2, and E3. The calibration signal generating unit 16 generates necessary calibration signals under control of the calibration control unit 15 and supplies the generated calibration signals to the adders 13. In order to make a distinction between the calibration signals for the antenna elements E0, E1, E2, and E3, the same calibration signal can be generated in a time divisional manner, or alternatively, calibration signals having different frequencies or codes can be generated for the separate antenna elements E0, E1, E2, and E3. That is, with respect to the calibration signals, the following three methods are applicable: the time-division multiplexing method, in which signal-emitting antenna elements are switched over time, the code-division multiplexing method, in which different antennas emit signals which are spread with different spreading codes, and the frequency-division multiplexing method, in which different antennas emit signals at different frequencies.

Further, the RF switch (switch unit) 17 selectively outputs RF signals electromagnetically coupled to the antennas DA and DB (hereinafter also called dummy antennas DA and DB), which are dummy antennas, under control by the calibration control unit 15, and makes the radio receiver unit 18 receive the selected RF signal. The radio receiver unit 18 carries out necessary radio reception processing including downconverting the RF signal, which is received via the radio receiver unit 18, to an intermediate frequency (IF) signal and to a baseband signal and specific demodulation processing. The calibration signal detecting unit 19 detects a calibration signal from a signal which is received by the dummy antenna DA or DB and is then output from the radio receiver unit 18, under control of the calibration control unit 15.

That is, the above RF switch 17, the radio receiver unit 18, and the calibration signal detecting unit 19 serve as a calibration signal detecting means for detecting calibration signals from signals received by the dummy antenna elements DA and DB disposed, one on each side of the adjacent antennas E0, E1, E2, and E3 to be subjected to calibration.

The weight generating unit 20 detects the phase differences among the calibration signals detected by the calibration signal detecting unit 19 and obtains weighting factors (weight values) to be supplied to the phase shifters 12.

Here, when the above calibration signals are sequentially (time-divisionally) sent (emitted) from each of the antenna elements E0, E1, E2, and E3, the weight generating unit 20 detects the calibration signal phase differences while accumulating each calibration signal detected time-divisionally by the calibration signal detecting unit 19 in a memory or the like. When the calibration signals are simultaneously sent from the antenna elements E0, E1, E2, and E3, at different frequencies or with different codes, the calibration signals, detected by the calibration signal detecting unit 19 according to their frequencies or codes, are differentiated based on their frequencies and codes, and their phase differences are detected.

That is, the calibration control unit 15 and the weight generating unit 20 serve as a calibration control means for controlling the phases of signals to be sent from the antenna elements E0, E1, E2, and E3 that are to be subjected to calibration, based on the above-described calibration signal phase differences. A block constituted of the calibration control unit 15, the calibration signal generating unit 16, the RF switch 17, the radio receiver unit 18, the calibration signal detecting unit 19, and the weight generating unit 20, serves as an array antenna calibration apparatus of the present invention.

Now, a downlink antenna calibration operation in a radio transmitter of the present embodiment with the above construction will be described.

Calibration signals generated by the calibration signal generating unit 16 are added (multiplexed) by the adders 13 to the main signals sent to the corresponding antenna elements E0, E1, E2, and E3, and then emitted from the antenna elements E0, E1, E2, and E3. The emitted calibration signals are electromagnetically coupled to the dummy antenna DA and the dummy antenna DB, and are then received by the radio receiver unit 18 via the RF switch 17. After that, the calibration signal detecting unit 19 detects the calibration signals from the received signals, and the detected calibration signals are then input to the weight generating unit 20, which detects the phase differences among the calibration signals received from the antenna elements E0, E1, E2, and E3 and calculates a weighting factor (weight value) for each of the antenna elements E0, E1, E2, and E3 (phase shifters 12).

Here, referring to FIG. 2, a description will be made of a method of detection of phase differences by the weight generating unit 20. Antenna element intervals are defined as indicated in the following table 1 and FIG. 2, the phases of signals at various parts are defined as shown in the following table 2.

TABLE 1

| Antenna Element Interval | |
|---|---|
| Between antenna elements DA–E0 | $d_{a0}$ |
| Between antenna elements E0–E1 | $d_{01}$ |
| Between antenna elements E1–E2 | $d_{12}$ |
| Between antenna elements E2–E3 | $d_{23}$ |
| Between antenna elements E3–DB | $d_{3b}$ |
| Between antenna elements DA–E1 | $d_{a1}$ |
| Between antenna elements DA–E2 | $d_{a2}$ |
| Between antenna elements DA–E3 | $d_{a3}$ |
| Between antenna elements E0–DB | $d_{0b}$ |
| Between antenna elements E1–DB | $d_{1b}$ |
| Between antenna elements E2–DB | $d_{2b}$ |

TABLE 2

| Phase at Various Parts | |
|---|---|
| Phase of signal at receiver end of dummy antenna element DA | $\phi_a$ |
| Phase of calibration signal of antenna element E0 | $\psi_0$ |
| Phase of calibration signal of antenna element E1 | $\psi_1$ |
| Phase of calibration signal of antenna element E2 | $\psi_2$ |

TABLE 2-continued

| Phase at Various Parts | |
|---|---|
| Phase of calibration signal of antenna element E3 | $\psi_3$ |
| Phase of signal at receiver end of dummy antenna element DB | $\phi_b$ |

First of all, a description will be made of a case where, as shown by the solid arrow 50 in FIG. 2, the calibration signal generating unit 16 generates calibration signals to send them out from the antenna 10 elements E0, E1, E2, and E3 via the adders 13 and the radio transmitter units 14, and the dummy antenna DA receives the calibration signals (when the RF switch 17 is switched to the dummy antenna DA side).

The phases of the calibration signals from the antenna elements E0, E1, E2, and E3, which signals are received by the dummy antenna DA, are shown in the following table 3. Note that in table 3 λ represents wavelength.

TABLE 3

| Phases of Calibration Signals Received by Dummy Antenna DA | |
|---|---|
| Phase of calibration signal from antenna element E0 | $\theta_{0a} = \psi_0 - 2\pi d_{a0}/\lambda + \phi_a$ |
| Phase of calibration signal from antenna element E1 | $\theta_{1a} = \psi_1 - 2\pi d_{a1}/\lambda + \phi_a$ |
| Phase of calibration signal from antenna element E2 | $\theta_{2a} = \psi_2 - 2\pi d_{a2}/\lambda + \phi_a$ |
| Phase of calibration signal from antenna element E3 | $\theta_{3a} = \psi_3 - 2\pi d_{a3}/\lambda + \phi_a$ |

Next, the phase differences in the calibration signals, which are received by the dummy antenna DA, between the antenna elements are obtained. As an example, the phase difference in the calibration signals between the adjacent antenna elements is obtained.

The phase difference $\theta_{01a}$ between the calibration signals of the antenna elements E0 and E1 is expressed by the following formula (1):

$$\begin{aligned}\theta_{01a} &= \theta_{0a} - \theta_{1a} \\ &= (\psi_0 - 2\pi d_{a0}/\lambda + \phi_a) - (\psi_1 - 2\pi d_{a1}/\lambda + \phi_a) \\ &= (\psi_0 - 2\pi d_{a0}/\lambda + \phi_a) - (\psi_1 - 2\pi(d_{a0} + d_{01})/\lambda + \phi_a) \\ &= \psi_0 - \psi_1 + 2\pi d_{01}/\lambda\end{aligned} \tag{1}$$

Likewise, the phase differences $\theta_{12a}$ and $\theta_{23a}$ in the calibration signals between the antenna elements E1 and E2, and between the antenna elements E2 and E3, respectively, are expressed by the following formulae (2) and (3):

$$\theta_{12a}=\theta_{1a}-\theta_{2a}=\psi_1-\psi_2+2\pi d_{12}/\lambda \tag{2}$$

$$\theta_{23a}=\theta_{2a}-\theta_{3a}=\psi_2-\psi_3+2\pi d_{23}/\lambda \tag{3}$$

Figure 2:
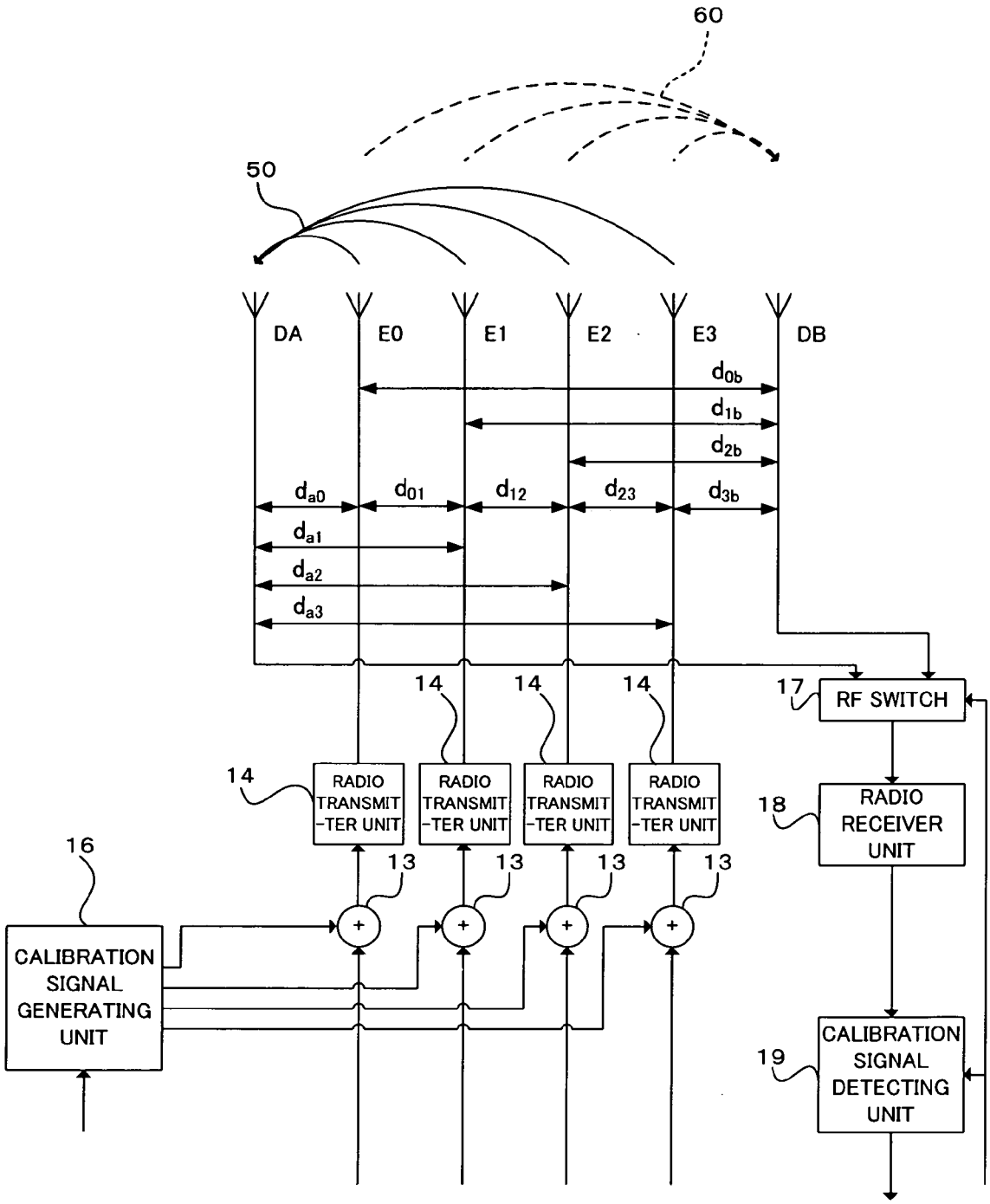
FIG. 2 is a diagram for describing an antenna calibration method for the radio transmitter (downlink) of FIG. 1.

Next, as shown by the dotted arrow 60 in FIG. 2, the dummy antenna DB receives calibration signals (the RF switch 17 is switched to the dummy antenna DB side under control of the calibration control unit 15). The calibration signals received by the dummy antenna DB from the antenna element E0, E1, E2, and E3 are shown in the following table 4.

TABLE 4

| Phases of Calibration Signals Received by Dummy Antenna DB | |
|---|---|
| Phase of calibration signal from antenna element E0 | $\theta_{0b} = \psi_0 - 2\pi d_{0b}/\lambda + \phi_b$ |
| Phase of calibration signal from antenna element E1 | $\theta_{1b} = \psi_1 - 2\pi d_{1b}/\lambda + \phi_b$ |
| Phase of calibration signal from antenna element E2 | $\theta_{2b} = \psi_2 - 2\pi d_{2b}/\lambda + \phi_b$ |
| Phase of calibration signal from antenna element E3 | $\theta_{3b} = \psi_3 - 2\pi d_{3b}/\lambda + \phi_b$ |

After that, as with the dummy antenna DA, the phase differences in the calibration signals between antenna elements, for example, the phase difference in the calibration signals between the adjacent antenna elements is obtained.

That is, the phase difference $\theta_{01b}$ in the calibration signals between the antenna elements E0 and E1 is expressed by the following formula (4):

$$\begin{aligned}\theta_{01b} &= \theta_{0b} - \theta_{1b} \\ &= (\psi_0 - 2\pi d_{0b}/\lambda + \phi_b) - (\psi_1 - 2\pi d_{1b}/\lambda + \phi_b) \\ &= (\psi_0 - 2\pi(d_{01} + d_{1b})/\lambda + \phi_b) - (\psi_1 - 2\pi d_{1b}/\lambda + \phi_b) \\ &= \psi_0 - \psi_1 + 2\pi d_{01}/\lambda\end{aligned} \tag{4}$$

Likewise, the phase differences $\theta_{12b}$ and $\theta_{23b}$ in the calibration signals between the antenna elements E1 and E2, and between the antenna elements E2 and E3, respectively, are expressed by the following formulae (5) and (6):

$$\theta_{12b}=\theta_{1b}-\theta_{2b}=\psi_1-\psi_2-2\pi d_{12}/\lambda \tag{5}$$

$$\theta_{23b}=\theta_{2b}-\theta_{3b}=\psi_2-\psi_3-2\pi d_{23}/\lambda \tag{6}$$

Next, each of the phase differences $\theta_{01a}$, $\theta_{12a}$, and $\theta_{23a}$, which have been obtained by the above formulae (1), (2), and (3), respectively, from the calibration signals received by the dummy antenna DA, and each of the phase differences $\theta_{01b}$, $\theta_{12b}$, and $\theta_{23b}$, which have been obtained by the above formulae (4), (5), and (6), respectively, from the calibration signals received by the dummy antenna DB are summed up like in the following formulae (7), (8), and (9).

$$\begin{aligned}2\theta_{01} &= \theta_{01a} + \theta_{01b} \\ &= (\psi_0 - \psi_1 + 2\pi d_{01}/\lambda) + (\psi_0 - \psi_1 - 2\pi d_{01}/\lambda) \\ &= 2(\psi_0 - \psi_1) \\ \therefore \theta_{01} &= \psi_0 - \psi_1\end{aligned} \tag{7}$$

$$\begin{aligned}2\theta_{12} &= \theta_{12a} + \theta_{12b} = 2(\psi_1 - \psi_2) \\ \therefore \theta_{12} &= \psi_1 - \psi_2\end{aligned} \tag{8}$$

$$\begin{aligned}2\theta_{23} &= \theta_{23a} + \theta_{23b} = 2(\psi_2 - \psi_3) \\ \therefore \theta_{23} &= \psi_2 - \psi_3\end{aligned} \tag{9}$$

As described above, using the dummy antenna DA and the dummy antenna DB, the calibration signals emitted from the antenna elements E0, E1, E2, and E3, are received to detect the calibration signal phase differences, and on the basis of the detected phase differences, each of the phase shifters 12 is individually controlled, so that calibration of the antenna elements E0, E1, E2, and E3, is accurately carried out without causing calibration error due to antenna element interval deviation.

[2] Second Embodiment

Figure 3:
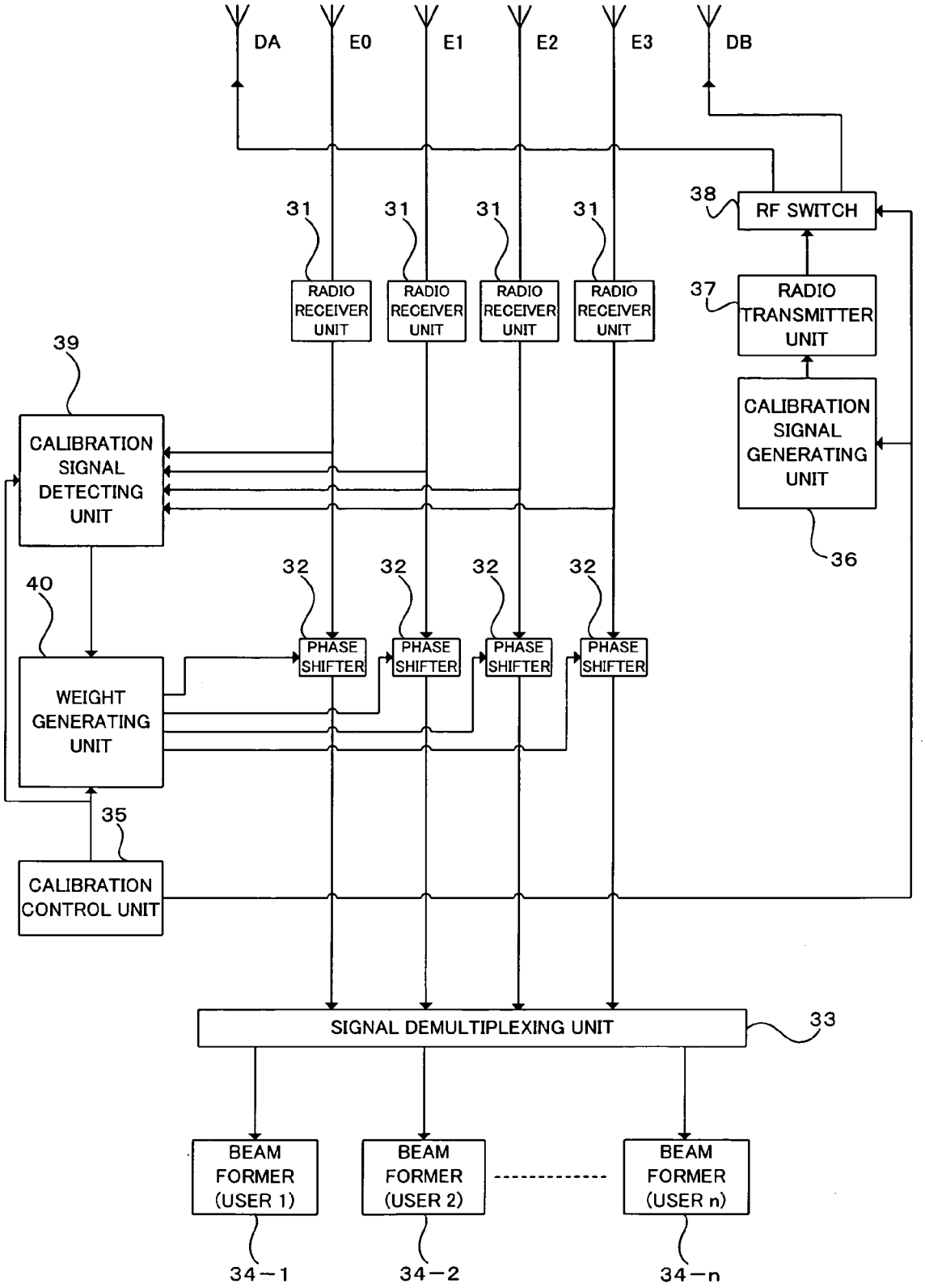
FIG. 3 is a block diagram showing a construction (uplink) of a radio receiver to which an array antenna calibration apparatus of a second embodiment of the present invention is applied.

FIG. 3 is a block diagram showing a construction (for uplink) of a radio receiver to which an array antenna calibration apparatus of a second embodiment of the present invention is applied. The radio receiver of FIG. 3 includes: antenna elements E0, E1, E2, E3, DA, and DB (in FIG. 3, a total of six antenna elements) constituting a linear array antenna; radio receivers 31 and phase shifters 32 provided, one for each of the antenna elements E0, E1, E2, and E3; a signal demultiplexing unit 33; beam formers 34-1 through 34-n (n is an integer not smaller than 2) for multiple users; a calibration control unit 35; a calibration signal generating unit 36; a radio transmitter unit 37; an RF switch 38; a calibration signal detecting unit 39; and a weight generating unit 40. In this example, also, antenna elements DA and DB, disposed one on each side of the linear array antenna, are dummy antennas for shaping emission patterns from the antenna elements E0, E1, E2, and E3.

Here, the radio receivers 31 perform necessary radio reception processing such as down conversion of radio signals received by the corresponding antenna elements E0, E1, E2, and E3 to an IF band and a base band, and specific demodulation. The phase shifters 32 adjust the phases of the signals output from the radio receivers 31 according to weighting factors obtained from the weight generating unit 40.

The signal demultiplexing unit 33 splits the signals (user multiplexed signal) that have been received by the antenna elements E0, E1, E2, and E3 and have undergone phase adjustment by the phase shifters 32 to each beam former 34-*i* (i=1 to n). Each beam former 34-*i* receives a user signal which forms a beam having a directivity for each user.

Further, the calibration control unit 35 controls calibration for the antenna elements E0, E1, E2, and E3. The calibration signal generating unit 36 generates necessary calibration signals under control by the calibration control unit 35. For example, it carries out switching between the dummy antenna DA and the dummy antenna DB which emit calibration signals, and controls the timing of detection of calibration signals received by the antenna elements E0, E1, E2, and E3.

The radio transmitter unit 37 performs necessary radio transmission processing such as modulating the calibration signals, which are generated by the calibration signal generating unit 36, using a specific modulation scheme, and upconverting the modulated signals to radio signals. The RF switch (switch unit) 38 selectively supplies calibration signals, received from the radio transmitter unit 37, to either of the dummy antenna elements DA and DB.

That is, the calibration signal generating unit 36, the radio transmitter unit 37, and the RF switch 38 serve as a calibration signal supply means for supplying calibration signals to dummy antenna elements DA and DB disposed, one on each side of the antenna elements E0, E1, E2, and E3 that are to be subjected to calibration.

Further, the calibration signal detecting unit 39 detects a calibration signal from the output of each radio receiver 31 under control by the calibration control unit 35. The weight generating unit 40 detects the phase differences among the calibration signals from the antenna elements E0, E1, E2, and E3, which calibration signals are detected by the calibration signal detecting unit 39, under control by the calibration control unit 35, and obtains weighting factors (weight values) to be supplied to the phase shifters 32.

That is, the above calibration control unit 35 and the weight generating unit 40 function as a calibration control means for controlling the phases of signals received by the antenna elements E0, E1, E2, and E3 that are to-be subjected to calibration, based on the above-described calibration signal phase differences. A block constituted of the calibration control unit 35, the calibration signal generating unit 36, the radio transmitter unit 37, the RF switch 38, the calibration signal detecting unit 39, and the weight generating unit 40, serves as an array antenna calibration apparatus of the present invention.

Now, a description will be made hereinbelow of an uplink antenna calibration operation performed on a radio receiver with the above construction according to the present embodiment.

A calibration signal generated by the calibration signal generating unit 36 is emitted by the dummy antenna DA or the dummy antenna DB via the radio transmitter unit 37 and the RF switch 38, and is then received by the antenna elements E0, E1, E2, and E3. The calibration signals received by the antenna elements E0, E1, E2, and E3 are demodulated by the radio receivers 31 and then detected by the calibration signal detecting unit 39. The weight generating unit 40 obtains the phase differences among the calibration signals detected by the weight generating unit 40 and calculates weight values for the phase shifters 32.

Here, referring to FIG. 4, a method for detecting a phase difference by the weight generating unit 40 will be explained. Intervals between the antenna elements are defined as shown in table 1 and FIG. 4, and the phases of signals at various parts are defined as shown in the following table 5.

TABLE 5

| Phase at Various Parts | |
|---|---|
| Phase of calibration signal at dummy antenna element DA | $\phi a$ |
| Phase of signal at receiver end for antenna element E0 | $\psi_0$ |
| Phase of signal at receiver end for antenna element E1 | $\psi_1$ |
| Phase of signal at receiver end for antenna element E2 | $\psi_2$ |
| Phase of signal at receiver end for antenna element E3 | $\psi_3$ |
| Phase of calibration signal at dummy antenna element DB | $\phi_b$ |

Figure 4:
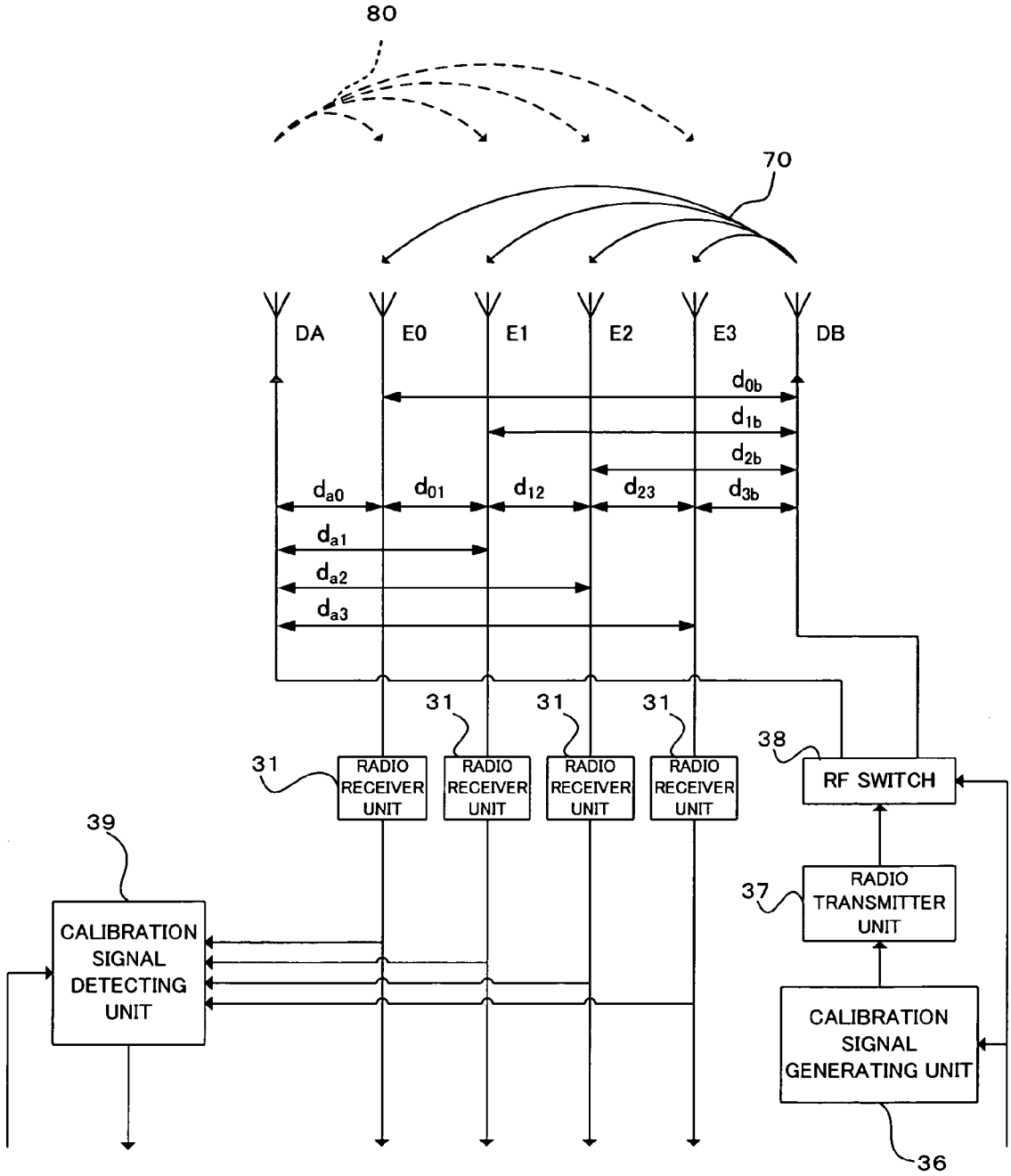
FIG. 4 is a diagram for describing an antenna calibration method for the radio receiver (uplink) of FIG. 3.

First of all, as shown by the dotted line 80 in FIG. 4, the calibration control unit 35 controls the RF switch 38 to select the dummy antenna DA, from which a calibration signal is then emitted.

The phases of the calibration signals received by the antenna elements E0, E1, E2, and E3 are shown in the following table 6.

TABLE 6

| Phases of Calibration Signals Received by Antenna Elements E0, E1, E2, and E3 | |
|---|---|
| Phase of calibration signal of antenna element E0 | $\theta_{0a} = \psi_0 - 2\pi d_{a0}/\lambda + \phi_a$ |
| Phase of calibration signal of antenna element E1 | $\theta_{1a} = \psi_1 - 2\pi d_{a1}/\lambda + \phi_a$ |
| Phase of calibration signal of antenna element E2 | $\theta_{2a} = \psi_2 - 2\pi d_{a2}/\lambda + \phi_a$ |
| Phase of calibration signal of antenna element E3 | $\theta_{3a} = \psi_3 - 2\pi d_{a3}/\lambda + \phi_a$ |

Next, the phase differences $\theta_{01a}$, $\theta_{12a}$, and $\theta_{23a}$ between the calibration signals from the antenna elements E0, E1, E2, and E3 (between antenna elements E0 and E1, antenna elements E1 and E2, and antenna elements E2 and E3) are obtained by the following formulae (10), (11), and (12).

$$\begin{aligned}\theta_{01a} &= \theta_{0a} - \theta_{1a} \\ &= (\psi_0 - 2\pi d_{a0}/\lambda + \phi_a) - (\psi_1 - 2\pi d_{a1}/\lambda + \phi_a) \\ &= (\psi_0 - 2\pi d_{a0}/\lambda + \phi_a) - (\psi_1 - 2\pi(d_{a0} + d_{01})/\lambda + \phi_a) \\ &= \psi_0 + 2\pi d_{01}/\lambda - \psi_1\end{aligned} \tag{10}$$

$$\theta_{12a} = \theta_{1a} - \theta_{2a} = \psi_1 + 2\pi d_{12}/\lambda - \psi_2 \tag{11}$$

$$\theta_{23a} = \theta_{2a} - \theta_{3a} = \psi_2 + 2\pi d_{23}/\lambda - \psi_3 \tag{12}$$

After that, as shown by the solid arrow 70 in FIG. 4, the calibration control unit 35 controls the RF switch 38 to select the dummy antenna DB, from which a calibration signal is then emitted. The phases of calibration signals received by the antenna elements E0, E1, E2, and E3 are shown in the following table 7.

TABLE 7

| Phases of Calibration Signals Received by Antenna Elements E0, E1, E2, and E3 | |
|---|---|
| Phase of calibration signal of antenna element E0 | $\theta_{0b} = \psi_0 - 2\pi d_{0b}/\lambda + \phi_b$ |
| Phase of calibration signal of antenna element E1 | $\theta_{1b} = \psi_1 - 2\pi d_{1b}/\lambda + \phi_b$ |
| Phase of calibration signal of antenna element E2 | $\theta_{2b} = \psi_2 - 2\pi d_{2b}/\lambda + \phi_b$ |
| Phase of calibration signal of antenna element E3 | $\theta_{3b} = \psi_3 - 2\pi d_{3b}/\lambda + \phi_b$ |

Next, the phase differences $\theta_{01b}$, $\theta_{12b}$and $\theta_{23b}$ between the calibration signals from the antenna elements E0, E1, E2, and E3 are obtained by the following formulae (13), (14), and (15).

$$\begin{aligned}\theta_{01b} &= \theta_{0b} - \theta_{1b} \\ &= (\psi_0 - 2\pi d_{0b}/\lambda + \phi_b) - (\psi_1 - 2\pi d_{1b}/\lambda + \phi_b) \\ &= (\psi_0 - 2\pi(d_{01} + d_{1b})d_{0b}/\lambda + \phi_b) - (\psi_1 - 2\pi d_{1b}/\lambda + \phi_b) \\ &= \psi_0 - 2\pi d_{01}/\lambda - \psi_1)\end{aligned} \tag{13}$$

$$\theta_{12b} = \theta_{1b} - \theta_{2b} = \psi_1 - 2\pi d_{12}/\lambda - \psi_2 \tag{14}$$

$$\theta_{23b} = \theta_{2b} - \theta_{3b} = \psi_2 - 2\pi d_{23}/\lambda - \psi_3 \tag{15}$$

Then, the phase differences $\theta_{01a}$, $\theta_{12a}$, and $\theta_{23a}$, which are obtained from the calibration signal emitted from the dummy antenna DA using the above formulae (10), (11), and (12) and the phase differences $\theta_{01b}$, $\theta_{12b}$, and $\theta_{23b}$, which are obtained from the calibration signal emitted from the dummy antenna DB using the above formulae (13), (14), and (15) are summed up as in the following formulae (16), (17), and (18).

$$\begin{aligned}2\theta_{01} &= \theta_{01a} + \theta_{01b} \\ &= (\psi_0 - \psi_1 + 2\pi d_{01}/\lambda) + (\psi_0 - \psi_1 - 2\pi d_{01}/\lambda) \\ &= 2(\psi_0 - \psi_1) \\ \therefore \theta_{01} &= \psi_0 - \psi_1\end{aligned} \tag{16}$$

$$\begin{aligned}2\theta_{12} &= \theta_{12a} + \theta_{12b} = 2(\psi_1 - \psi_2) \\ \therefore \theta_{12} &= \psi_1 - \psi_2\end{aligned} \tag{17}$$

-continued $$\begin{aligned}2\theta_{23} &= \theta_{23a} + \theta_{23b} = 2(\psi_2 - \psi_3) \\ \therefore \theta_{23} &= \psi_2 - \psi_3\end{aligned} \tag{18}$$

As described above, the calibration signals are emitted using the dummy antenna elements DA and DB, and the calibration signals are received by the antenna elements E0, E1, E2, and E3, to detect the calibration signal phase difference. This makes it possible to accurately calibrate the antenna elements E0, E1, E2, and E3, without causing calibration error due to antenna element interval deviation.

[3] Third Embodiment

Figure 5:
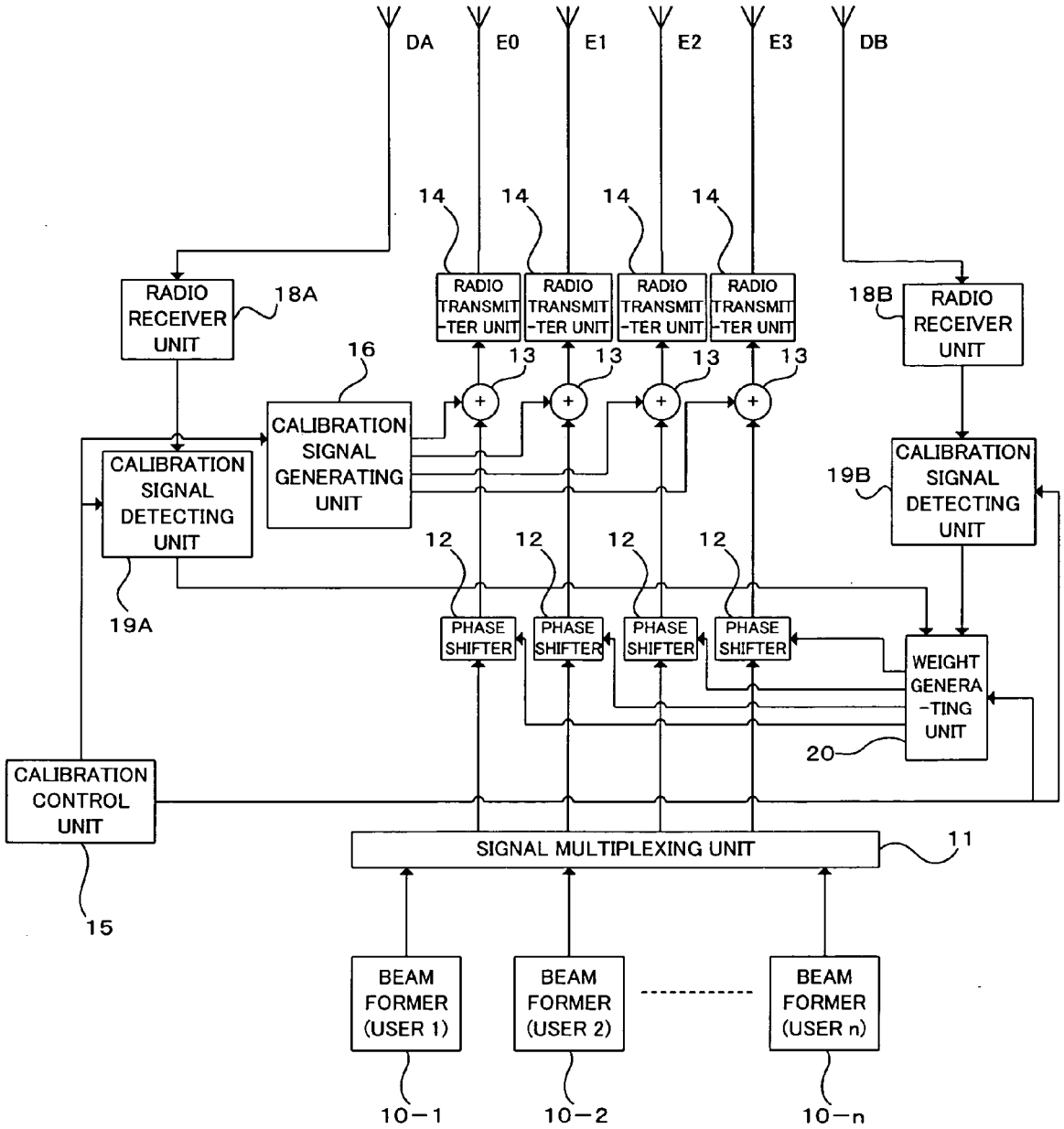
FIG. 5 is a block diagram showing a construction (downlink) of a radio transmitter to which an array antenna calibration apparatus of a third embodiment of the present invention is applied.

FIG. 5 is a block diagram showing a construction (for downlink) of a radio transmitter to which an array antenna calibration apparatus of a third embodiment of the present invention is applied. The radio transmitter of FIG. 5 differs from the construction of FIG. 1 in that radio receiver units 18A and 18B and calibration signal detecting units 19A and 19B are provided for the dummy antenna elements DA and DB, respectively, instead of the RF switch 17.

Here, the radio receiver units 18A and 18B per se have the same or the similar functions to those of the radio receiver unit 18 already described. The calibration signal detecting units 19A and 19B per se have functions the same as or similar to those of the calibration signal detecting unit 19 already described. That is, although the construction of FIG. 1 includes one radio receiver unit 18 and one calibration signal detecting unit 19 for common use between the dummy antenna elements DA and DB by a switching operation of the RF switch 17, the present embodiment prepares radio receiver units 18A and 18B and calibration signal detecting units 19A and 19B dedicated to the dummy antenna elements DA and DB, respectively.

This construction also realizes like effects and benefits to those of the first embodiment. More specifically, the dummy antenna elements DA and DB receive calibration signals emitted from the antenna elements E0, E1, E2, and E3 and detect the phase differences among the received calibration signals. On the basis of the phase differences detected, the phase shifters 12 are individually controlled, thereby making it possible to accurately calibrate the antenna elements E0, E1, E2, and E3, without causing calibration error due to antenna element interval deviation.

Here, two radio receiver units are sufficient, irrespective of the number of antenna elements other than dummy antenna elements DA and DB.

[4] Fourth Embodiment

Figure 6:
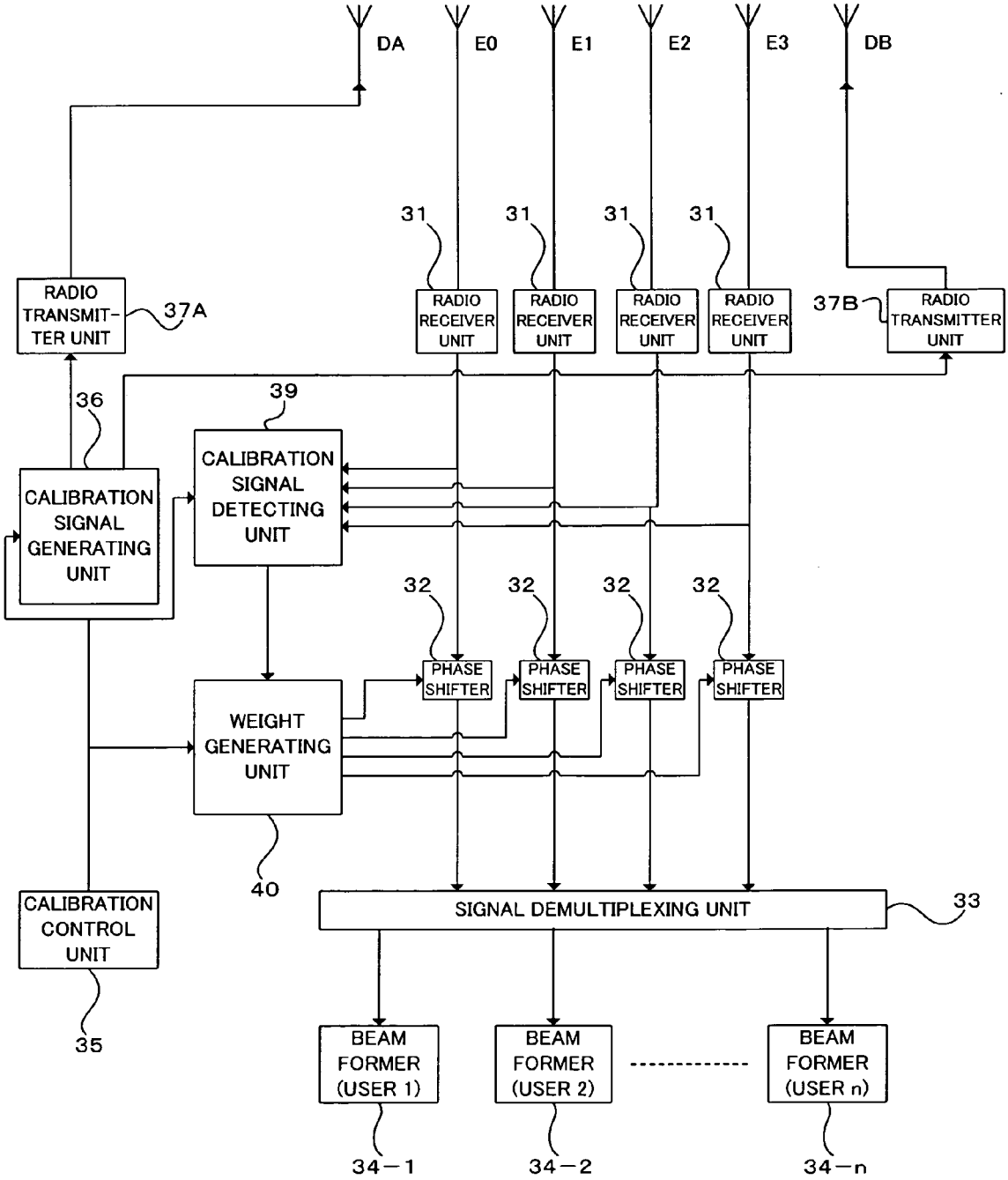
FIG. 6 is a block diagram showing a construction (uplink) of a radio receiver to which an array antenna calibration apparatus of a fourth embodiment of the present invention is applied.

FIG. 6 is a block diagram showing a construction (for uplink) of a radio receiver to which an array antenna calibration apparatus of a fourth embodiment of the present invention is applied. The radio receiver of FIG. 6 differs from the construction of FIG. 3 in that radio transmitters 37A and 37B are provided for the dummy antennas DA and DB, respectively, instead of the RF switch 38.

Here, each of the radio transmitter units 37A and 37B per se has functions the same as or similar to those of the radio transmitter unit 37. That is, although the construction of FIG. 3 includes one radio transmitter unit 37 for common use between the dummy antenna elements DA and DB by a switching operation of the RF switch 38, the present embodiment prepares radio transmitter units 37A and 37B.

This construction also realizes like effects and benefits to those of the second embodiment. More specifically, the dummy antenna elements DA and DB emit calibration signals, and the antenna elements E0, E1, E2, and E3 receive the calibration signals to detect the phase difference between the received calibration signals, so that it is possible to accurately calibrate the antenna elements E0, E1, E2, and E3, without causing calibration error due to antenna element interval deviation.

As calibration signals, the time-division multiplexing scheme, in which signal-emitting antennas are switched over time, and the code-division multiplexing scheme, in which the antenna elements emit signals that are spread by different spreading codes, and the frequency-division multiplexing scheme, in which the different antennas emit signals at different frequencies, are applicable.

Here, as shown in FIG. 5, two radio transmitter units are sufficient, irrespective of the number of antenna elements other than dummy antenna elements DA and DB.

[5] Fifth Embodiment

Figure 7:
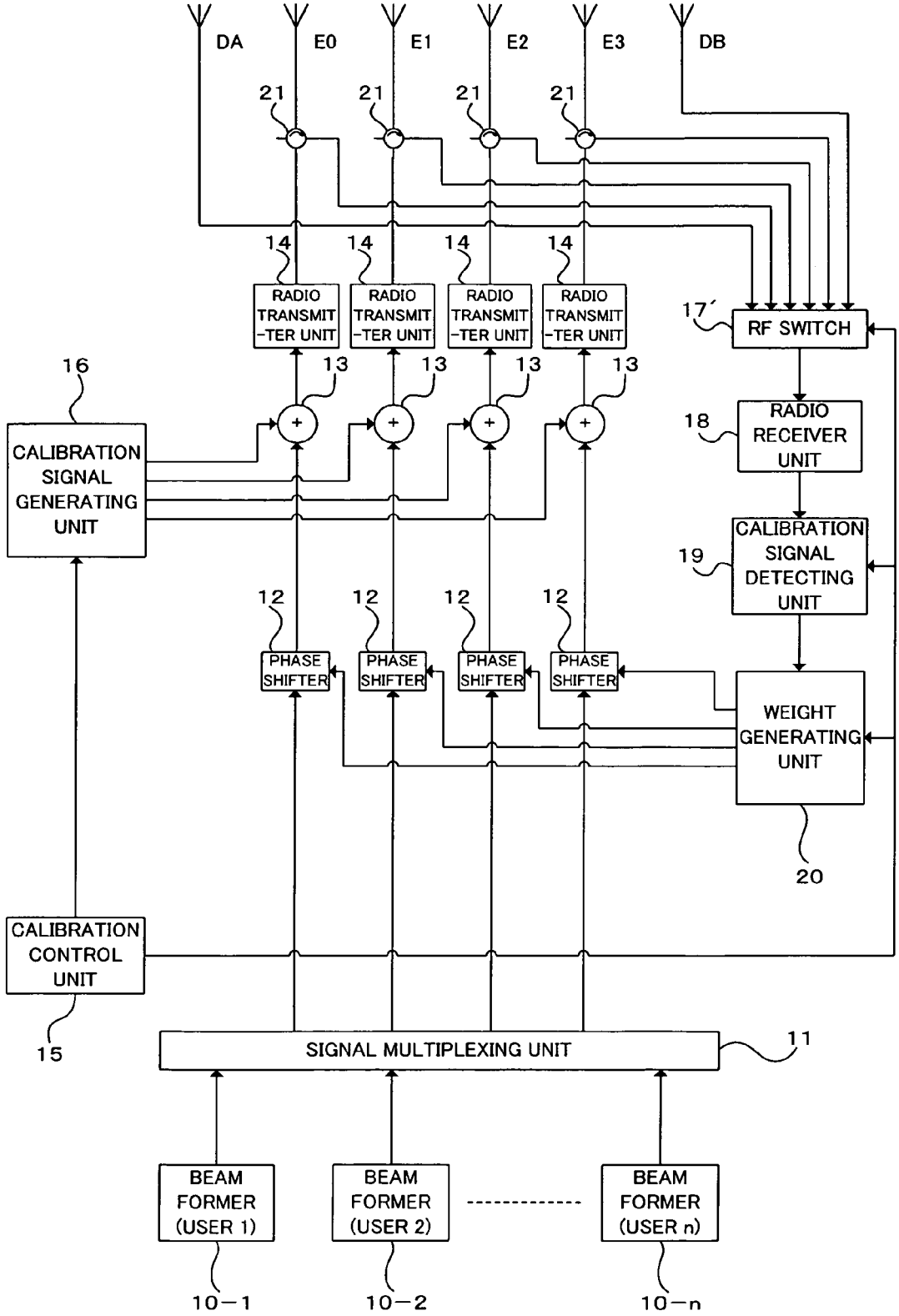
FIG. 7 is a block diagram showing a construction (downlink) of a radio transmitter to which an array antenna calibration apparatus of a fifth embodiment of the present invention is applied.

FIG. 7 is a block diagram showing a construction (for downlink) of a radio transmitter to which an array antenna calibration apparatus of a fifth embodiment of the present invention is applied. For the purpose of using the antenna elements E0, E1, E2, and E3, in addition to the dummy antenna elements DA and DB, as antenna elements for receiving calibration signals, the radio transmitter of FIG. 7 differs from the construction in FIG. 1 in that circulators 21, which serve as split means for splitting a part of a received signal from the main received signal, are provided, one for each of the antenna elements E0, E1, E2, and E3, and in that an RF switch 17', which selectively outputs the signals from the antenna elements E0, E1, E2, and E3 (circulators 21) and from the dummy antenna elements DA and DB to the radio receiver unit 18, is provided instead of the RF switch 17. Like reference numbers and characters designate similar parts or elements throughout several views of the embodiments, so their detailed description is omitted here.

This construction makes it possible for the antenna elements E0, E1, E2, and E3, in addition to the dummy antenna elements DA and DB, to receive calibration signals, thereby realizing more flexible calibration of the antenna elements E0, E1, E2, and E3.

For example, when the antenna elements E0 and E1 are calibrated, the antenna elements DA and E2 disposed, one on each side of the adjacent antenna elements E0 and E1 can be used for calibration. More specifically, signals emitted from the antenna elements E0 and E1 are received by the dummy antenna element DA. Likewise, signals emitted from the antenna elements E0 and E1 are also received by the antenna element E2. In this manner, as with the first embodiment, the calibration signal phase difference is detected, and on the basis of the thus detected phase difference, the phase shifters 12 are individually controlled, so that each antenna element is accurately calibrated without causing calibration error due to antenna element interval deviation.

[6] Sixth Embodiment

Figure 8:
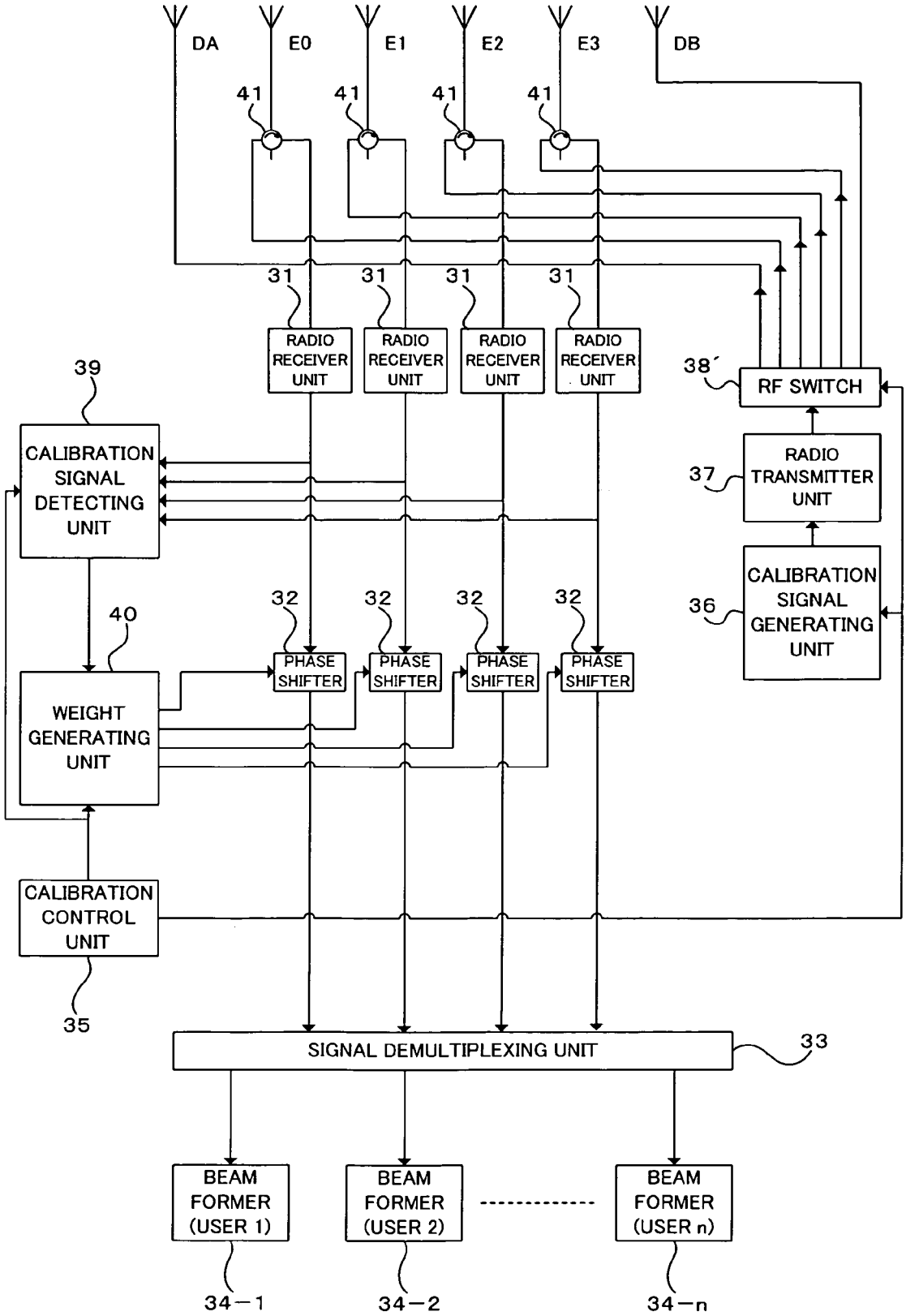
FIG. 8 is a block diagram showing a construction (uplink) of a radio receiver to which an array antenna calibration apparatus of a sixth embodiment of the present invention is applied.
Figure 9:
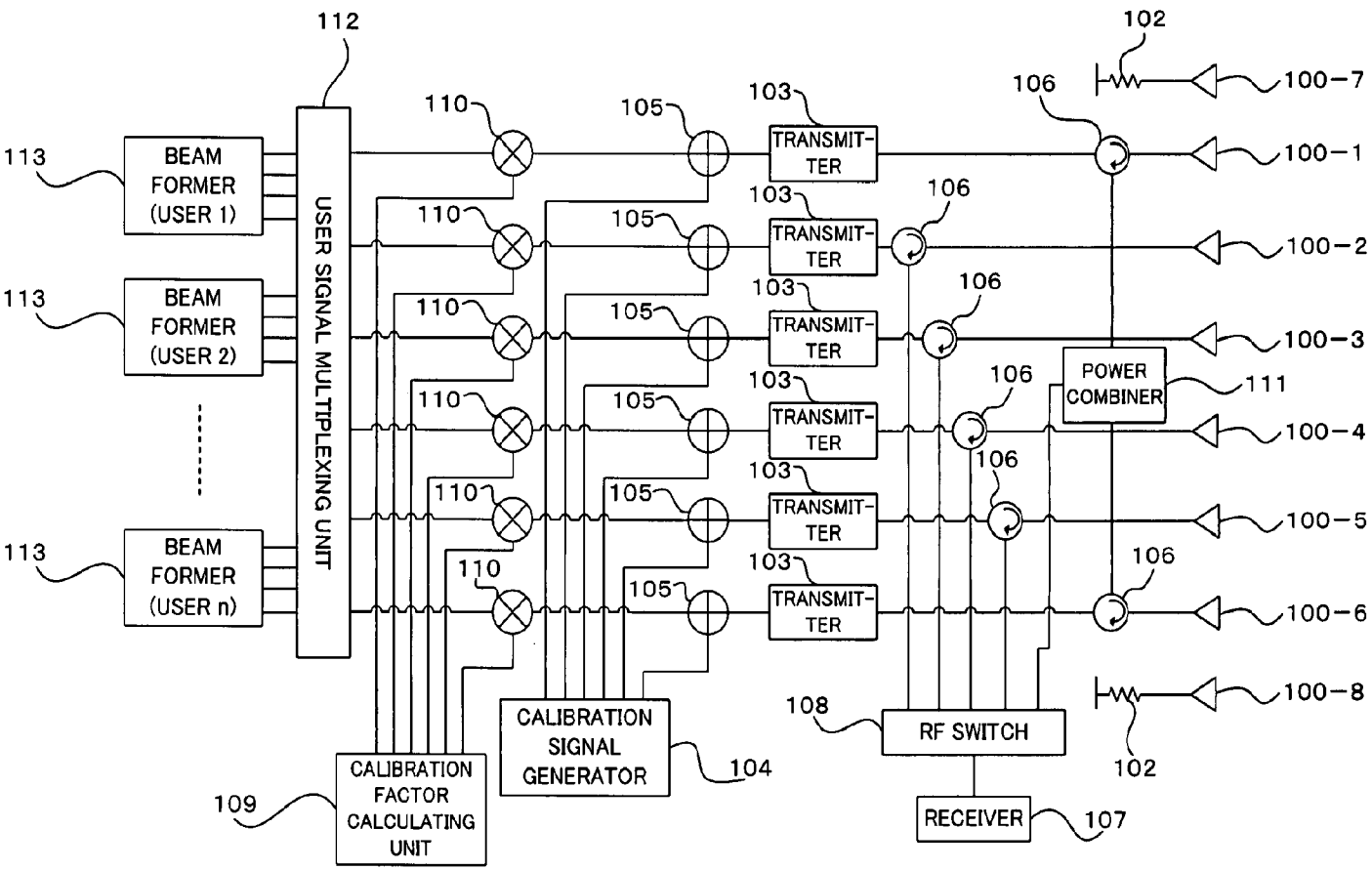
FIG. 9 RELATED ART
FIG. 9 is a block diagram showing a construction of a radio transmitter for describing a conventional antenna calibration method.

FIG. 8 is a block diagram showing a construction (for uplink) of a radio receiver to which an array antenna calibration apparatus of a sixth embodiment of the present invention is applied. For the purpose of using the antenna elements E0, E1, E2, and E3, in addition to the dummy antenna elements DA and DB, as antenna elements for sending (emitting) calibration signals, the radio receiver of FIG. 8 differs from the construction already described with reference to FIG. 3 in that circulators 41, which make it possible to send calibration signals without causing interference with received signals, are provided, one for each of the antenna elements E0, E1, E2, and E3, and in that an RF switch 38', which selectively outputs the signals from the radio transmitter unit 37 to the antenna elements E0, E1, E2, and E3 (circulators 41) and to the dummy antenna elements DA and DB, is provided instead of the RF switch 38. Like reference numbers and characters designate similar parts or elements throughout several views of the embodiments, so their detailed description is omitted here.

This construction makes it possible for the antenna elements E0, E1, E2, and E3, in addition to the dummy antenna elements DA and DB, to send calibration signals, thereby realizing more flexible calibration of the antenna elements E0, E1, E2, and E3.

For example, when the antenna elements E0 and E1 are calibrated, the antenna elements DA and E2 disposed, one on each side of the adjacent antenna elements E0 and E1 can be used for calibration. More specifically, a signal emitted from the antenna element DA is received by the antenna elements E0 and E1. Likewise, a signal emitted from the antenna element E2 is also received by the antenna elements E0 and E1. In this manner, as with the second embodiment, the calibration signal phase difference is detected, and on the basis of the thus detected phase difference, the phase shifters 32 are individually controlled, so that each antenna element is accurately calibrated without causing calibration error due to antenna element interval deviation.

As described above, for both a downlink and an uplink, dummy antenna elements DA and DB, which are normally provided for shaping an emission pattern, are used as antenna elements for receiving and sending calibration signals, and calibration can be carried out from two directions, so that accurate, antenna-element-interval-independent calibration is realized. Accordingly, antenna element interval deviation is allowed, and array antenna yields are reduced, thereby contributing to reduction of the manufacturing cost.

Further, the present invention should by no means be limited to the above-illustrated embodiments, and various changes or modifications may be suggested without departing from the gist of the invention.

What is claimed is:

1. An array antenna calibration apparatus for calibrating an array antenna having multiple antenna elements, said apparatus comprising:

calibration signal supply means which supplies calibration signals to a plurality of antenna elements that are to be subjected to calibration;

calibration signal detecting means which detects the calibration signals from signals transmitted by each of the plurality of antenna elements that are to be subjected to calibration and received by each calibrating antenna elements placed, one on each side of the plurality of antenna elements that are to be subjected to calibration, and calibration control means which individually controls the phases of signals to be transmitted from each of the plurality of antenna elements that are to be subjected to calibration, based on the phase differences among the calibration signals detected by said calibration signal detecting means.

2. An array antenna calibration apparatus as set forth in claim 1, wherein said calibration signal detecting means includes:

a switch unit which selectively outputs signals received by the calibrating antenna elements placed, one on each side of the plurality of antenna elements that are to be subjected to calibration;

a radio receiver unit which receives an output signal of said switch unit; and a calibration signal detecting unit which detects the calibration signal from the signal received by said radio receiver unit.

3. An array antenna calibration apparatus as set forth in claim 2, wherein said calibration signal detecting means detects the calibration signal from a signal received by each of said plurality of antenna elements that are to be subjected to calibration.

4. An array antenna calibration apparatus as set forth in claim 1, wherein said calibration signal detecting means includes:

a plurality of radio receiver units provided, one for each of the calibrating antenna elements that are placed, one on each side of the plurality of antenna elements that are to be subjected to calibration, said plurality of radio receiver units receiving signals which are received by the calibrating antenna elements placed, one on each side of the plurality of antenna elements that are to be subjected to calibration; and a plurality of calibration signal detecting units, provided one for each of said plurality of radio receiver units, for detecting the calibration signal from the signal received by each of said plurality of radio receiver units.

5. An array antenna calibration apparatus as set forth in claim 4, wherein said calibration signal detecting means detects the calibration signal from a signal received by each of said plurality of antenna elements that are to be subjected to calibration.

6. An array antenna calibration apparatus as set forth in claim 1, wherein said calibration signal detecting means detects the calibration signal from a signal received by each of said plurality of antenna elements that are to be subjected to calibration.

7. An array antenna calibration apparatus as set forth in claim 1, wherein the calibrating antenna elements placed, one on each side of the plurality of antenna elements that are to be subjected to calibration are dummy antenna elements.

8. An array antenna calibration apparatus as set forth in claim 1, wherein any of time-division multiplexed signals, code-division multiplexed signals, and frequency-division multiplexed signals are supplied as the calibration signals.

9. An array antenna calibration apparatus for calibrating an array antenna having multiple antenna elements, said apparatus comprising:

calibration signal supply means which supplies calibration signals to calibrating antenna elements placed, one on each side of a plurality of antenna elements that are to be subjected to calibration;

calibration signal detecting means which detects the calibration signals from signals transmitted by each of the calibrating antenna elements and received by each of the plurality of antenna elements that are to be subjected to calibration; and calibration control means which individually controls the phases of the signals received by each of the plurality of antenna elements that are to be subjected to calibration, based on the phase difference among the calibration signals detected by said calibration signal detecting means.

10. An array antenna calibration apparatus as set forth in claim 9, wherein said calibration signal supply means includes:

a calibration signal generating unit which generates the calibration signals;

a radio transmitter unit which sends the calibration signals, which are generated by said calibration signal generating unit, as radio signals;

a switch unit which selectively outputs the radio signals from said radio transmitter unit to the calibrating antenna elements placed, one on each side of the plurality of antenna elements that are to be subjected to calibration.

11. An array antenna calibration apparatus as set forth in claim 9, wherein said calibration signal supply means includes:

a calibration signal generating unit which generates the calibration signals;

a plurality of radio transmitter units provided, one for each of the calibrating antenna elements that are placed, one on each side of the plurality of antenna elements that are to be subjected to calibration, said plurality of radio transmitter units sending the calibration signals, which are generated by said calibration signal generating unit, as radio signals.

12. An array antenna calibration apparatus as set forth in claim 9, wherein the calibrating antenna elements placed, one on each side of the plurality of antenna elements that are to be subjected to calibration are dummy antenna elements.

13. An array antenna calibration apparatus as set forth in claim 9, wherein said calibration signal supply means supplies any of time-division multiplexed signals, code-division multiplexed signals, and frequency-division multiplexed signals.

14. An array antenna calibration method for calibrating an array antenna having multiple antenna elements, said method comprising:

emitting calibration signals from a plurality of antenna elements that are to be subjected to calibration;

detecting the calibration signals from signals transmitted by each of the plurality of antenna elements that are to be subjected to calibration and received by each of calibrating antenna elements that are placed, one on each side of the plurality of antenna elements that are to be subjected to calibration; and controlling individually the phases of signals to be sent from each of the plurality of antenna elements that are to be subjected to calibration based on the phase differences among the detected calibration signals.

15. An array antenna calibration method as set forth in claim 14, wherein the calibrating antenna elements placed, one on each side of the plurality of antenna elements that are to be subjected to calibration are dummy antenna elements.

16. An array antenna calibration method as set forth in claim 14, wherein any of time-division multiplexed signals, code-division multiplexed signals, and frequency-division multiplexed signals are supplied as the calibration signals.

17. An array antenna calibration method for calibrating an array antenna having multiple antenna elements, said method comprising:

emitting calibration signals from calibrating antenna elements placed, one on each side of a plurality of antenna elements that are to be subjected to calibration;

detecting the calibration signals from signals transmitted by each of the calibrating antenna elements and received by each of the plurality of antenna elements that are to be subjected to calibration; and controlling individually the phases of the signals received by each of the plurality of antenna elements that are to be subjected to calibration based on the phase differences among the detected calibration signals.

18. An array antenna calibration method as set forth in claim 17, wherein the calibrating antenna elements placed, one on each side of the plurality of antenna elements that are to be subjected to calibration are dummy antenna elements.

19. An array antenna calibration method as set forth in claim 17, wherein any of time-division multiplexed signals, code-division multiplexed signals, and frequency-division multiplexed signals are supplied as the calibration signals.

* * * * *